United States Patent [19]

Wahlquist

[11] 3,984,949

[45] *Oct. 12, 1976

[54] PORTABLE ROOM CONSTRUCTION

[75] Inventor: Carl D. Wahlquist, Woodland Hills, Calif.

[73] Assignee: Building Components Research, Inc., Salt Lake City, Utah

[ * ] Notice: The portion of the term of this patent subsequent to Feb. 4, 1992, has been disclaimed.

[22] Filed: Nov. 11, 1974

[21] Appl. No.: 522,664

[52] U.S. Cl. ..... 52/70; 52/143

[51] Int. Cl.[2] ..... E04B 1/343

[58] Field of Search ..... 52/64, 70, 71, 27, 143

[56] References Cited

UNITED STATES PATENTS

| | | | |
|---|---|---|---|
| 2,765,497 | 10/1956 | Ludowici | 52/70 |
| 2,962,132 | 11/1960 | Reinhardt | 52/143 |
| 3,231,942 | 2/1966 | O'Brien | 52/70 |
| 3,534,512 | 10/1970 | Ballas | 52/143 X |
| 3,563,257 | 2/1971 | Cummins | 52/71 |
| 3,863,404 | 2/1975 | Wahlquist | 52/143 X |

*Primary Examiner*—J. Karl Bell

*Attorney, Agent, or Firm*—H. Ross Workman; J. Winslow Young

[57] ABSTRACT

A building construction and method for transforming a large open space into a plurality of smaller rooms. A portable room module is folded into an essentially planar configuration for storage. The module is supported upon retractable wheels and accommodates movement from a storage location to a predetermined utility location within a larger room. In the utility location, the portable room module is expanded to room size and an elevated ceiling unit is lowered so as to rest upon the room module and form a ceiling unit therefor. Partially collapsible insulating material is situated at joints of the wall portions of the room module and also at the top and bottom of the wall portions so as to form an acoustic and hermetic seal when the module is unfolded and when the elevated ceiling unit comes to rest upon the wall panels. The weight of the ceiling unit simultaneously (a) displaces the wall panel vertically downward over the retractable wheels to secure the position of the wall panels and (b) compresses the insulating material at both the top and bottom of the wall panel.

9 Claims, 10 Drawing Figures

PORTABLE ROOM CONSTRUCTION

BACKGROUND

1. Field of the Invention

This invention relates to building construction and more particularly to structure and method for transforming a large space into a plurality of smaller spaces.

2. The Prior Art

It has long been desirable to achieve maximum utility of space by providing structure for selectively dividing a large space into smaller spaces or rooms. Conventionally, movable wall partitions or dividers have been used for this purpose. See, for example, U.S. Pat. Nos. 3,107,400; 3,295,257; 3,331,426 and applicant's copending patent application Ser. No. 386,900 filed Aug. 9, 1973 now U.S. Pat. No. 3,863,404.

Numerous problems have traditionally been associated with conventional wall partitions. For example, where the wall partitions must attach or affix directly to bearing walls, substantial structural alteration frequently must be made. Moreover, most conventional wall partitions must be stored inside the larger space and are frequently attached to the walls of the larger space.

It has been found desirable to provide a portable room structure which can be stored at a remote location and, when desired, quickly and easily assembled to form a complete room in the larger space.

BRIEF DESCRIPTION AND OBJECTS OF THE INVENTION

The present invention, including structure and method, provides a portable room module formed from an assembly of interior wall panels which are easily displaced from a folded to an unfolded enclosure-forming configuration. The room module is situated in register with an elevated ceiling unit which is thereafter lowered upon the unfolded room module so as to form an acoustic and hermetic insulation at top and bottom of the panel joint, the weight of the ceiling simultaneously downwardly displacing the wall panels to secure the room module in the unfolded position.

It is, therefore, a primary object of the present invention to provide improved structure for dividing a large space into smaller spaces.

It is another primary object of the present invention to provide an improved method for dividing a space into a plurality of smaller rooms.

These and other objects and features of the present invention will become more fully apparent from the following description and appended claims taken in conjunction with the accompanying drawings.

DETAILED DESCRIPTION OF THE PREFERRED EMBODIMENTS

Reference is now made to the drawings wherein like parts are designated with like numerals throughout.

Figure 1:
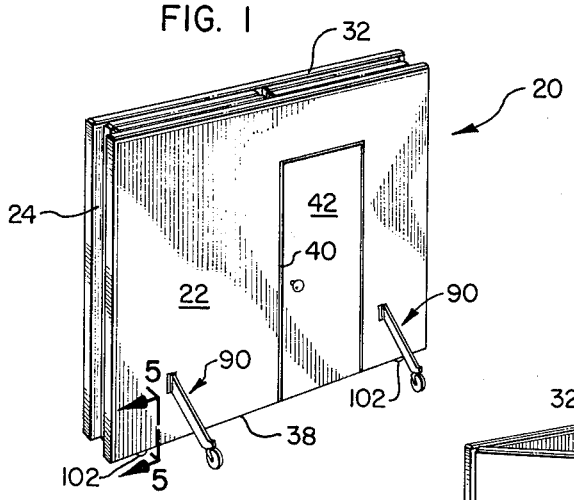
FIG. 1 is a schematic perspective view of one presently preferred embodiment of the room module assembly in a collapsed, storage configuration.
Figure 2:
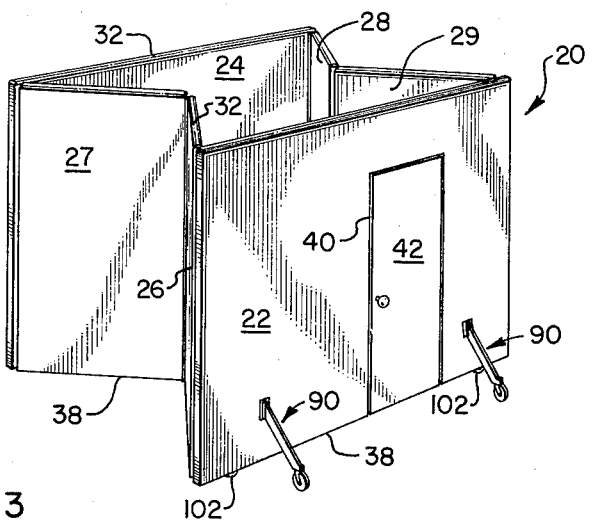
FIG. 2 is a schematic perspective view of the assembly of FIG. 1 in the partially unfolded configuration.

Referring particularly to FIGS. 1 and 2, a room module or wall panel assembly generally designated 20 includes front wall 22 and rear wall 24. In the folded position illustrated in FIG. 1, the front wall 22 and rear wall 24 are parallel one to the other and separated only by the folded side wall partitions 26, 27, 28 and 29.

Side wall panels 26 and 29 are hingedly connected to the front wall panel 22. Similarly, the side wall panels 27 and 28 are hingedly connected to the rear wall panel 24. Further, the side wall panels 26 and 27 are hingedly connected together such as with a hinge 30 (see FIG. 8). Side wall panels 28 and 29 are similarly joined.

Figure 8:
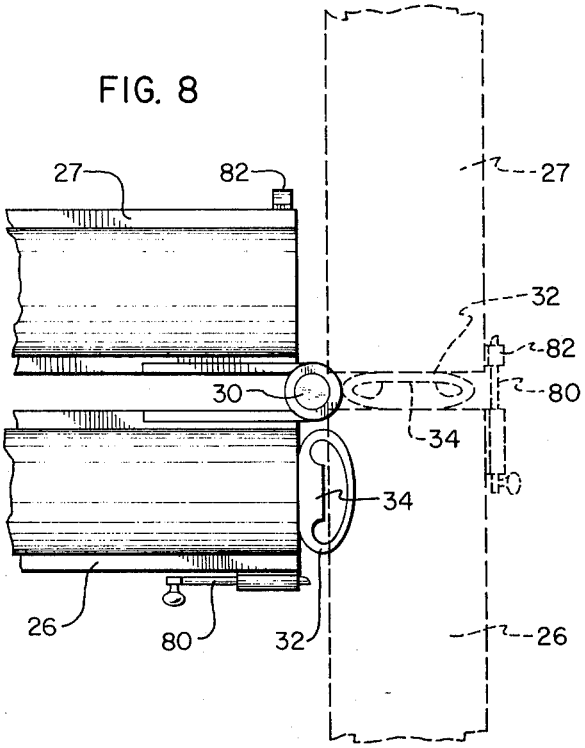
FIG. 8 is a fragmentary plan view of folded wall panels, the unfolded position being shown in broken lines and illustrating the formation of a seal therebetween.

Each vertical joint of the assembly 20 is provided with a tubular insulator 32, shown best in FIG. 8. While any suitable insulator providing acoustic and hermetic seal may be used, the illustrated insulator 32 is presently preferred. The tubular insulator is mounted upon one of the surfaces forming the joint, e.g. along the vertical edge of the side wall panels 26–29. The insulators 32 are formed of suitable resilient flexible material such as rubber or urethane and have a generally tubular configuration.

An inwardly projecting rib 34 traverses the length of the hollow of the tubular insulator 32. Significantly, the rib 34 prevents total collapse of the tubular insulator 32 when the insulator is compressed by the wall panels 22, 24 and 26–29 in the unfolded position. Accordingly, even when collapsed, the insulator 32 provides dead air space along its length which has the effect of providing surprisingly effective acoustical insulation in addition to hermetic insulation. It has also been found highly desirable to mount tubular insulators 32 along both the top surfaces 36 of the wall panels (see FIG. 4) and also the bottom surfaces 38 (see FIGS. 1 and 2) of the wall panel assembly 20.

The front wall panel 22 is preferably fitted with a door frame 40 onto which a conventional door 42 has been hung. The door 42 permits access to the room created when the assembly is in the fully unfolded position illustrated in FIG. 3.

Figure 3:
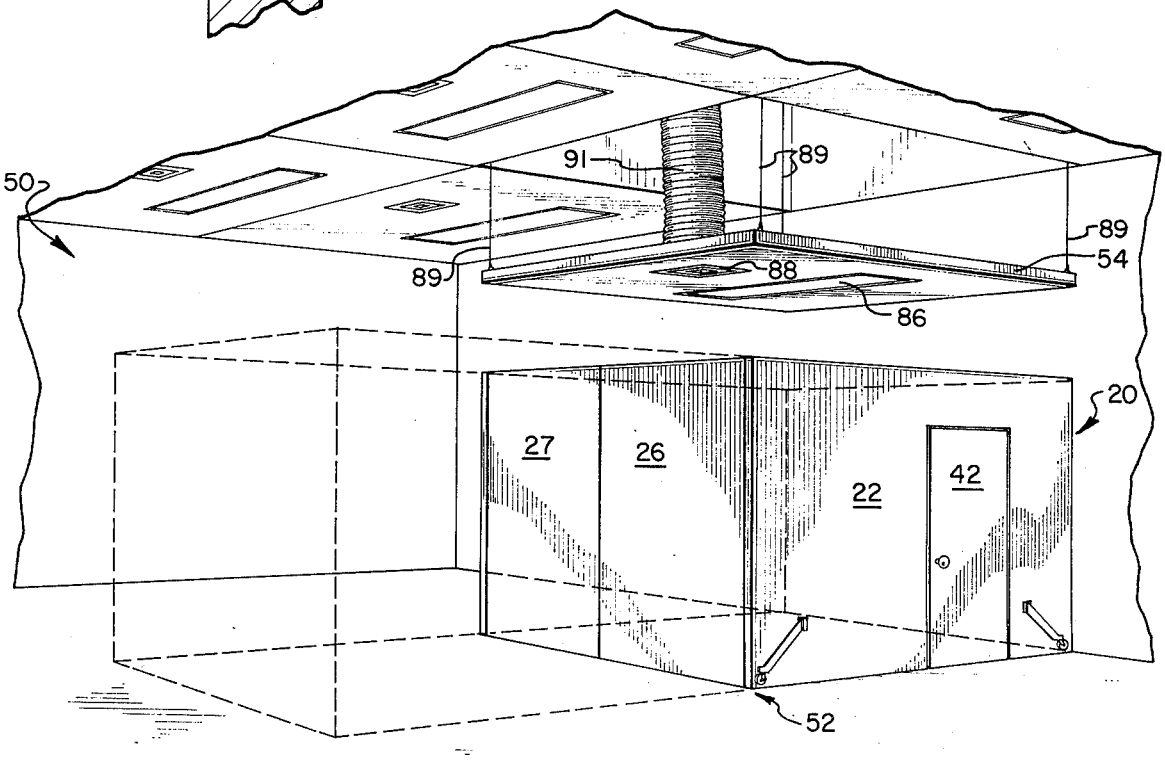
FIG. 3 is a schematic perspective illustration of the assembly of FIGS. 1 and 2 in a fully unfolded position with a ceiling element partially lowered toward the unfolded room configuration.
Figure 5:
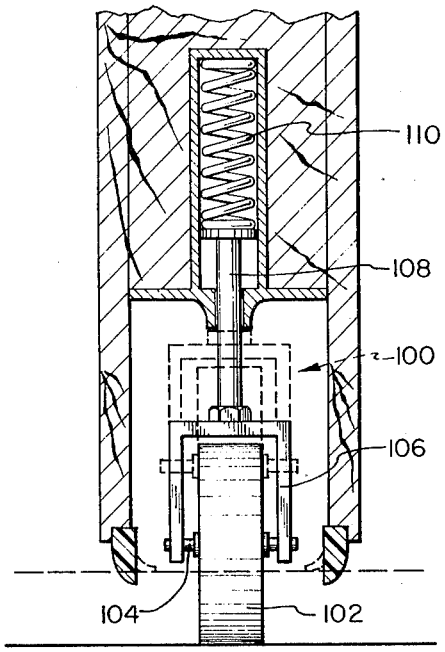
FIG. 5 is a transverse cross-sectional view along lines 5—5 FIG. 1 specifically illustrating a preferred retractable caster structure.

According to the presently preferred use of the invention, the assembly 20, in the folded position, would be stored in a suitable location until its use, for example, in the room 50 illustrated in FIG. 3, is desired. The assembly 20, folded as shown in FIG. 1, is then retrieved from its place of storage and displaced into the room 50. Preferably, the folded assembly 20 is brought to a predetermined location 52 in the room 50, which location 52 is in register with a vertically adjustable ceiling panel 54, hereinafter more fully described. Movement of the assembly 20 is facilitated by suspending the wall panel assembly on a plurality of roller assemblies 100, one of which is best illustrated in FIG. 5. Each roller assembly 100 comprises a conventional caster 102 rotatably carried upon an axle 104 held by a generally U-shaped bracket 106. The bracket is rigidly mounted upon a plunger 108 which is biased into the extended full-line position by spring 110. The resistance of the spring 110 is selected to be sufficient to lift the weight of the wall panel assembly 20. Accordingly, the wall panel assembly is easily displaced from place to place upon the roller assemblies 100.

However, when the wall panel assembly 20 is forced downwardly, i.e. when the weight of the ceiling unit 54 is allowed to rest thereupon, the resistance of spring 110 is overcome such that the wall panel assembly 20 is downwardly displaced against the bias of the spring 110 to the broken line position. In the broken line position, the wall panel is secured in place. In this specification, displaceable wheels means casters or glides which recess into the wall panels as the panels are downwardly displaced under the weight of the ceiling unit. Insulators 32, as previously described, are situated along the bottom periphery of the wall panel assembly 20. Nevertheless, in order to facilitate use of the casters 102, a portion of the insulator 32 (not shown in FIG. 5) must be removed from the bottom of the wall panel assembly. Acoustical and hermetic insulation is improved at the location of the casters 102 through the use of a flexible seal 112 mounted to the wall panel and situated on both sides of the caster. When the wall panel is displaced downwardly with the weight of the ceiling unit 54, the insulators 112 are compressed against the floor surface to form a seal.

Figure 9:
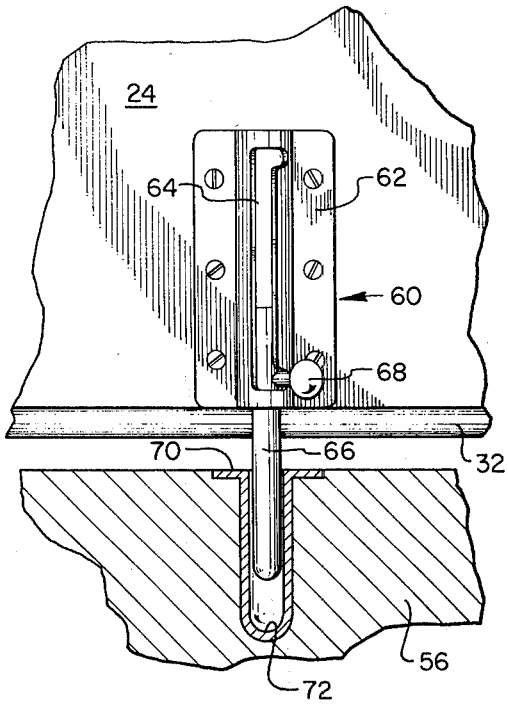
FIG. 9 is an elevational view, shown partly in cross section, of anchor structure for maintaining the position of the room assembly after it has been moved into place in alignment with the ceiling panel of FIG. 3.

After the folded assembly 20 has been brought into position in the room 50 (FIG. 3) it is desirable to fix the position of the assembly 20 on the floor 56 to assure that the assembly 20, when unfolded as shown in FIG. 3, is in register with the ceiling unit 54. For this purpose the anchor structure generally designated 60 and best shown in FIG. 9 is provided. The anchor 60 is preferably mounted upon the exterior of the back wall panel 24 and comprises a bracket 62 having a centrally disposed channel 64 therein. The channel 64 permits a bolt 66 to reciprocate therein in a well-known manner. A control lever 68 is used to displace the bolt 66 within the channel 64. At spaced predetermined locations in the floor 56 (compare FIG. 3), a metal receiver 70 is mounted. The receiver 70 receives the bolt 66 to fix the position of the back wall 24 relative to the floor 56.

It is observed that the bolt 66, even in its fully projecting position, is spaced above the bottom 72 of receiver 70. This space is desirable to permit the wall panel 24 to be displaced downwardly under the weight of the ceiling unit 54 to collapse the top and bottom insulators 32. Any desirable number of anchors 60 may be provided on each assembly 20. Presently, it has been found that two are most desirable so as to fix the plane of the rear panel 24. Also, it has been found desirable to anchor the rear panel 24 in advance of unfolding the assembly 20 as shown in FIGS. 2 and 3 so that the unfolding can be accommodated easily by merely drawing the front wall panel 22 away from the anchored rear panel 24.

When the assembly 20 is in the fully unfolded position of FIG. 3, it is presently preferred that the side wall panels 26, 27 and 28, 29 be locked to prevent inadvertent collapse of the room assembly. Referring now to FIG. 8, a slide bolt 80 is carried by the side wall panel 26, the bolt being adapted to mate with a collar 82 as shown in broken lines in FIG. 8. With the assembly 20 in the fully unfolded position, it is ready to receive the ceiling unit 54. Any suitable conventional means can be used for displacing the ceiling unit, including, for example, a cable and winch assembly. In the elevated position, the ceiling unit 54 does not influence the position of the wall panel assembly 20. Accordingly, until the ceiling unit 54 is lowered upon the assembly 20, the entire assembly 20 will be downwardly displaced against the bias of spring 110 (FIG. 5). Simultaneously, the weight of the ceiling unit 54 will collapse insulators 32 above and beneath the panel assembly 20 so as to form an acoustical and hermetic seal at the ceiling and floor respectively. The seal at the interface of the front wall 22 and lowered ceiling unit is shown best in FIG. 4.

The construction of the ceiling unit 54 accommodates significant advantages not otherwise available in building structures. For example, light fixtures 86 can be permanently installed in the ceiling unit 54. In addition, an air flow duct 88 can be permanently installed and connected to a flexible conduit 91 for providing heat and air-conditioning to each individual room as it is formed.

Figure 6:
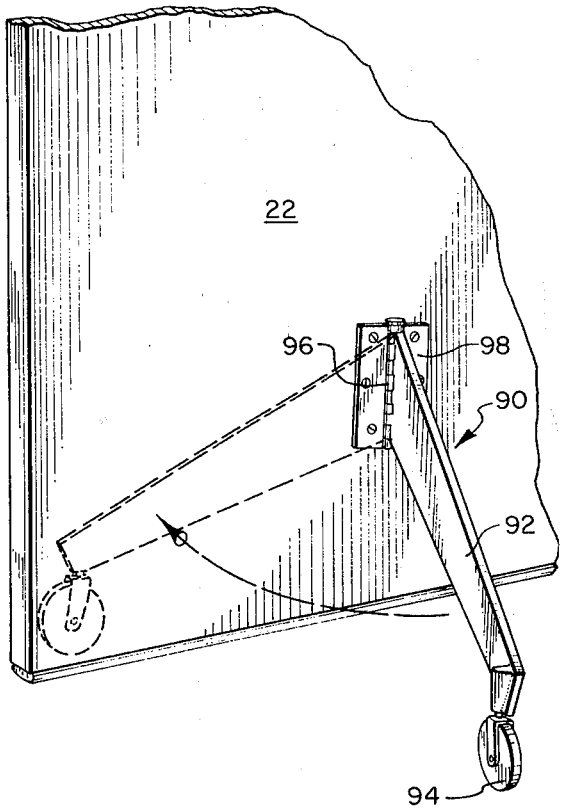
FIG. 6 is an enlarged fragmentary perspective view of one presently preferred caster stabilizer embodiment.

It has been found that when the assembly 20 is folded in the position in FIG. 1, it may have some inherent instability when moved from place to place. This instability apparently results from the fact that the wall panels, which may be between 7 and 8 feet tall, have only a very narrow base upon which they are supported. Accordingly, it has been found desirable in some instances to include stabiizers generally designated 90 and best shown in FIG. 6. The stabilizers 90 are preferably attached to at least one of the front or rear wall panels 22, or 24 and project outwardly away from the center of gravity of the folded assembly 20. The stabilizers 90 include a leg 92 to which a rotatable caster 94 has been attached. The caster 94 facilitates the displaceability of the folded panel assembly 20. The leg 92 is connected by a hinge 96 to a bracket 98. Preferably, the bracket is aligned such that when the leg 92 is rotated from the unfolded (solid line) position to the folded (broken line) position, the caster 94 is lifted away from the floor to facilitate downward displacement of the assembly 20 when the ceiling unit 54 rests thereon (see FIG. 3). Preferably, the hinge 96 has a bias point which resists movement of the leg 92 once it has been placed in either the solid line or broken line positions illustrated so that the leg 92 will not inadvertently move as the assembly 20 is moved from place to place.

Figure 7:
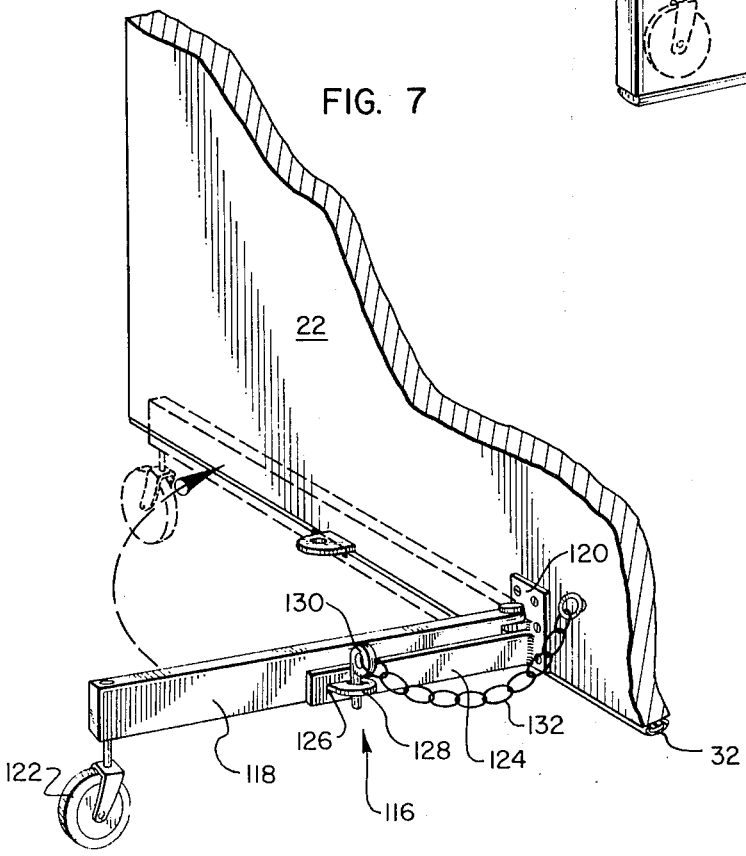
FIG. 7 is a fragmentary perspective of still another stabilizer embodiment, the folded position of the stabilizer being shown in broken lines.

An alternative stabilizer embodiment generally designated 116 is shown in FIG. 7. In this embodiment, a leg 118 is hingedly anchored at 120 to at least one of the front wall panel 22 or rear wall panel 24. The leg 118 is provided with a caster 122 which is spring-biased downwardly to the position illustrated in FIG. 7. The bracket 120 has an outward projection 124 which defines a generally horizontal slot 126. A perforated tongue 128, integral with the leg 118, projects through the slot 126 and receives a pin 130 to secure the leg 118 in the extended position. If desired, a tether 132 may be used to prevent loss of the pin 130 when not in use. When desired, the pin 130 can be removed and the leg 118 folded to the broken line position against the wall panel 22. Because the casters 122 are spring-biased downwardly, when the wall panel 22 is displaced with the assembly 20 by the weight of the ceiling unit 54, the casters will retract to permit a seal with the floor at insulator 32.

Figure 10:
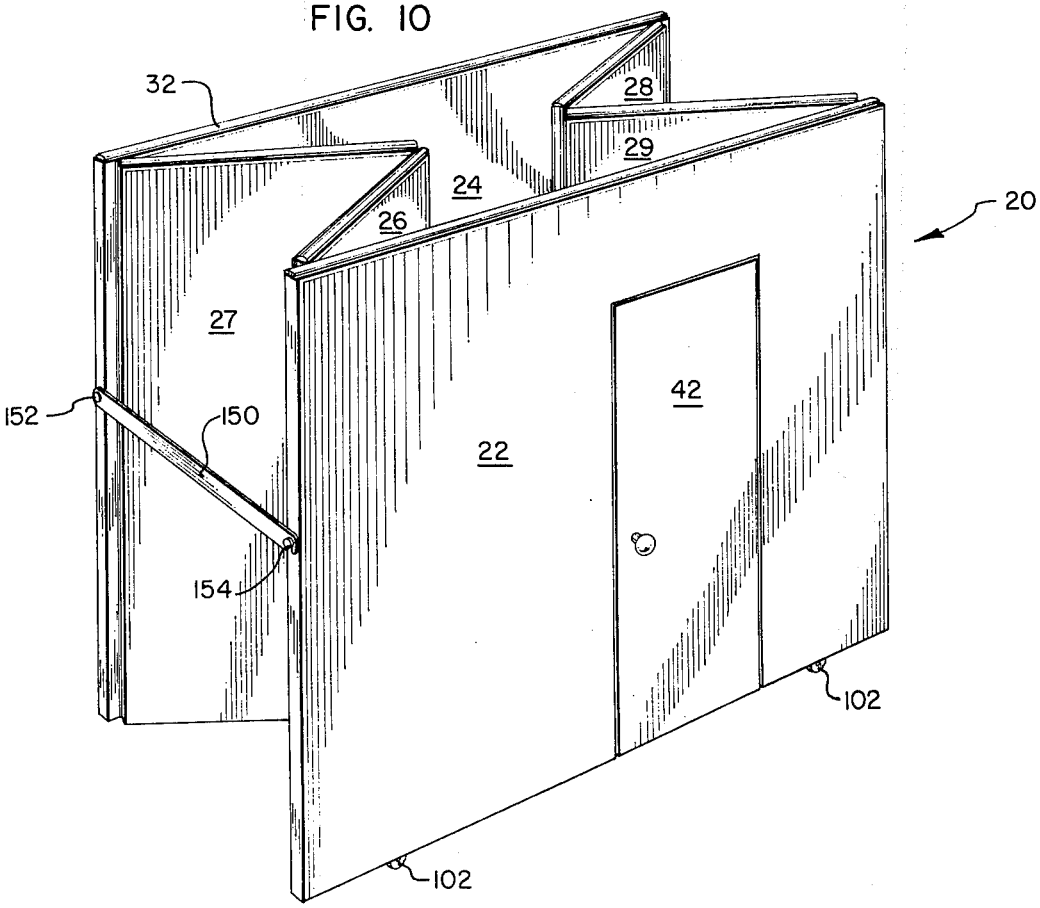
FIG. 10 illustrates an alternative embodiment of stabilizing structure useful to transport the illustrated wall panel assembly safely from place to place.

FIG. 10 illustrates still another preferred stabilizing embodiment. In FIG. 10, a rigid bar 150 is rotatably attached to at 152 to the edge of wall panel 24. The bar 150 is detachably connected at 154 to the wall panel 22. Thus, the assembly 20 is maintained at an increased transverse dimension (essentially the length of bar 150) during the period of time in which it is transported from place to place thereby giving stability to the assembly 20 during the movement thereof.

The method of assemblying and using the portable room structure is clear from the foregoing description. The assembly 20 in the folded position shown in FIG. 1, is displaced from a storage position in the storage configuration to a predetermined room site 52 in a larger space. Desirably, the wall panel 24 is anchored using an anchor device such as that illustrated in FIG. 9. Thereafter, the wall panel 22 is displaced away from the wall panel 24 simultaneously unfolding the panels 26 through 29. To assure that the assembly 20 will not inadvertently fold, anchor structure such as the bolt illustrated in FIG. 8 secures the position of the panels 26, 27 and 28, 29. The room assembly 20 is then in the unfolded position illustrated in FIG. 3. It is observed that seals will then exist on all of the vertical joints of the room assembly due to the compression of tubular insulators 32 (see FIG. 8).

Figure 4:
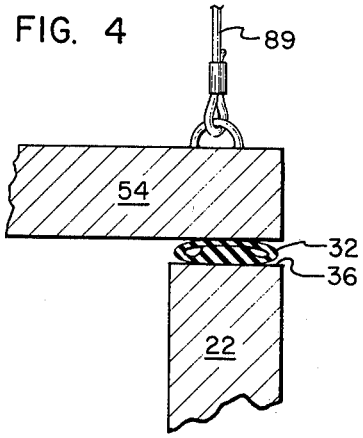
FIG. 4 is a fragmentary cross-sectional view of the wall panel and associated seal with the ceiling unit lowered thereon.

The ceiling unit 54 is then lowered by cables 89 until at least a portion of the weight of the ceiling unit 54 rests upon the assembly 20. The assembly 20 is displaced downwardly by the weight of the ceiling unit 54 causing the casters 102 (FIG. 5) to retract within the corresponding wall panels. Also, as shown in FIG. 4, a seal is formed by insulators 32 at the ceiling and floor joints.

The assembly 20 may be removed by reversing the described procedure. More particularly, the ceiling unit 54 may be raised so as to allow the assembly 20 to be lifted upon the casters 102 by the bias of spring 110 (FIG. 5). Thereafter, the bolts 80 unlatch side panels 26, 27 and 28, 29 (see FIG. 8) permitting the side panels to fold one upon the other as the wall panel 22 is collapsed toward the panel 24. Subsequently, the anchors 60 (FIG. 9) are lifted to permit the folded assembly 20 to be displaced to a convenient storage location.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A building structure comprising in combination:

an assembly of generally vertically-oriented wall panels together forming the four walls of a room and serially joined together to accommodate (a) folding at least one of the wall panels upon the other into a storage configuration and (b) unfolding the wall panels into an enclosed room configuration, the assembly of wall panels comprising means facilitating displacement of the entire assembly from place to place at least when in the storage configuration;

a ceiling unit suspended above the wall panel, the ceiling unit comprising means for selectively lowering at least part of the weight of the ceiling unit upon the unfolded assembly wall panels; and means interposed above and below the wall panels for forming a seal when the weight of the ceiling unit is brought to rest upon the wall panel assembly.

2. A building structure as defined in claim 1 further comprising downwardly biased displaceable wheels providing facile movement of the wall panels acrossed floor surface, the displaceable wheels being selectively telescoped into the interior of the wall panel when the wall panel is downwardly displaced in response to the weight of the ceiling unit upon the wall panel assembly.

3. A building structure as defined in claim 1 wherein said assembly of wall panels comprises front and rear wall panels and side wall panels, said side wall panels being hinged in the vertical plane to permit the side wall panels to fold inwardly between the front and rear panels as the front and rear panels are brought together so that both front and rear wall panels and side wall panels, in the folded configuration, are each essentially parallel to the next.

4. A building structure as defined in claim 1 wherein said ceiling unit comprises means for vertically displacing the ceiling unit between a first elevated position and a second lowered position, engaging the unfolded assembly of wall panels.

5. A building structure as defined in claim 4 wherein said ceiling unit comprises an air delivery opening and a light source which, when the ceiling unit is in the lower, wall panel-engaging position, delivers air and light.

6. A building structure as defined in claim 1 wherein said seal forming means comprises a generally flexible tubular insulator having an axially aligned inwardly directed projection which prevents total collapse of the insulator when the insulator is compressed under pressure.

7. A building structure as defined in claim 1 further comprising displaceable wheel means spaced laterally away from the center of gravity of the at least partially folded assembly for stabilizing the folded assembly.

8. A building structure as defined in claim 7 wherein said means comprises an outwardly projecting leg and associated caster which, in a first position, stabilizes the folded assembly and, in a second position, is displaced into a plane essentially parallel with at least one of the wall panels.

9. A building structure as defined in claim 7 wherein said means comprises a spacing bar for laterally spacing at least two of the wall panels and associated displaceable wheels to lend stability to the partially folded assembly.

* * * * *